US010472122B2

(12) United States Patent
Aguirre

(10) Patent No.: US 10,472,122 B2
(45) Date of Patent: Nov. 12, 2019

(54) CONTAINER WITH A REINFORCEMENT STRUCTURE AND METHOD OF FORMING THE SAME

(71) Applicant: WestRock Shared Services, LLC, Norcross, GA (US)

(72) Inventor: Ray Aguirre, Whittier, CA (US)

(73) Assignee: WestRock Shared Services, LLC, Atlanta, GA (US)

( * ) Notice: Subject to any disclaimer, the term of this patent is extended or adjusted under 35 U.S.C. 154(b) by 187 days.

(21) Appl. No.: 15/412,777

(22) Filed: Jan. 23, 2017

(65) Prior Publication Data

US 2017/0210504 A1 Jul. 27, 2017

Related U.S. Application Data

(60) Provisional application No. 62/287,740, filed on Jan. 27, 2016.

(51) Int. Cl.
*B65D 5/32* (2006.01)
*B65D 5/00* (2006.01)

(52) U.S. Cl.
CPC ..... *B65D 5/323* (2013.01); *B65D 5/00* (2013.01)

(58) Field of Classification Search
CPC ..... B65D 5/323; B65D 5/00; B65D 5/002; B65D 5/001; B65D 5/0025; B65D 5/445
USPC ..... 229/125.33, 918, 919, 109, 122.24, 199, 229/122.32, 916, 186; 206/509, 503; 493/128, 162
See application file for complete search history.

(56) References Cited

U.S. PATENT DOCUMENTS 3,709,425 A * 1/1973 Stapp ..... B65D 5/446 229/122.22
5,593,087 A * 1/1997 Ross ..... B65D 5/003 229/109
6,186,393 B1 * 2/2001 Tsamourgelis ..... B65D 5/32 229/122.26
7,624,912 B2 * 12/2009 Churvis ..... B65D 5/443 229/122.24

* cited by examiner

*Primary Examiner* — Christopher R Demeree
(74) *Attorney, Agent, or Firm* — WestRock IP Legal

(57) ABSTRACT

A blank assembly for forming a container includes a body blank that includes a bottom panel and two opposing side panels. The side panels are configured to at least partially form two opposing side walls of the container. The blank assembly also includes at least two end blanks. Each end blank is configured to form at least a portion of an end wall of the container. Each end blank includes a first inner corner panel, a first inner end panel, a first reinforcement panel, a second reinforcement panel, and a second inner end panel coupled together in series along preformed, parallel fold lines. The first inner corner panel is configured to extend obliquely between a side wall and an end wall. The first reinforcement panel is configured to extend from the first inner end panel inwardly towards an interior cavity of the container.

23 Claims, 5 Drawing Sheets

CONTAINER WITH A REINFORCEMENT STRUCTURE AND METHOD OF FORMING THE SAME

REFERENCE TO RELATED APPLICATIONS

This application claims the benefit of priority under 35 U.S.C. § 119(e) of U.S. provisional application Ser. No. 62/287,740 filed on Jan. 27, 2016, which is hereby incorporated by reference in its entirety.

BACKGROUND

The field of the present disclosure relates generally to packaging containers and, more particularly, to a container having a body blank and opposing reinforcing end blanks that form a reinforced shipping container with enhanced stacking strength.

At least some known containers that are used to transport and/or store products may be stacked on top of each other when the products are being transported or stored. The side walls of the containers on the lower layers of the stack are configured to support a weight of the containers on the upper layers of the stack. However, if the weight on a lower container causes the side walls of the lower container to bulge outwardly or inwardly, a bottom wall of an upper container can settle into, or "nest" within, a cavity defined by the sidewalls of the lower container. Products within the lower container may then be required to support the weight of the upper layers. Alternatively, the stacked containers may completely collapse or fall over when the side walls of the lower stacked containers bulge. In either case, the products within the containers may be damaged during transport and/or storage.

BRIEF DESCRIPTION

In one aspect, a blank assembly for forming a container is provided. The blank assembly includes a body blank that includes a bottom panel and two opposing side panels. Each of the two side panels extends from one of two opposing side edges of the bottom panel. The two side panels are configured to at least partially form two opposing side walls of the container. The blank assembly also includes at least two end blanks. Each end blank is configured to form at least a portion of one of two opposing end walls of the container. Each end blank includes a first inner corner panel, a first inner end panel, a first reinforcement panel, a second reinforcement panel, and a second inner end panel coupled together in series along a plurality of preformed, parallel fold lines. The first inner corner panel is configured to extend obliquely between one of the side walls and one of the end walls, and the first reinforcement panel is configured to extend from the first inner end panel inwardly towards an interior cavity of the container, when the container is formed.

In another aspect, a container formed from a body blank and at least two end blanks of sheet material is provided. The container includes a bottom wall that includes a bottom panel of the body blank, and two opposing side walls emanating from opposing side edges of the bottom wall. The container also includes two opposing end walls. Each end wall includes a first inner end panel, a first reinforcement panel, a second reinforcement panel, and a second inner end panel of one of the end blanks coupled together in series along a plurality of preformed, parallel fold lines. The container further includes a first inner miter wall emanating from a side edge of the first inner end panel of a first of the end walls. The first inner miter wall extends obliquely between the first end wall and a first of the side walls. The first reinforcement panel extends from the first inner end panel inwardly towards an interior cavity of the container.

In another aspect, a method of forming a container from a body blank and at least two end blanks of sheet material is provided. The method includes rotating a bottom panel and two opposing side panels of the body blank about a plurality of fold lines of the body blank to at least partially form a bottom wall and two opposing side walls. The method also includes rotating a first inner corner panel and first and second reinforcement panels of each end blank with respect to first and second inner end panels of the respective end blank about a plurality of parallel fold lines of the respective end blank. The method further includes coupling the first and second inner end panels of each end blank to the body blank to form two opposing end walls of the container, such that the first inner corner panel extends obliquely from a side edge of the first inner end panel of a first of the end walls to a first of the side walls, and such that the first reinforcement panel extends from the first inner end panel inwardly towards an interior cavity of the container.

DETAILED DESCRIPTION

Figure 1:
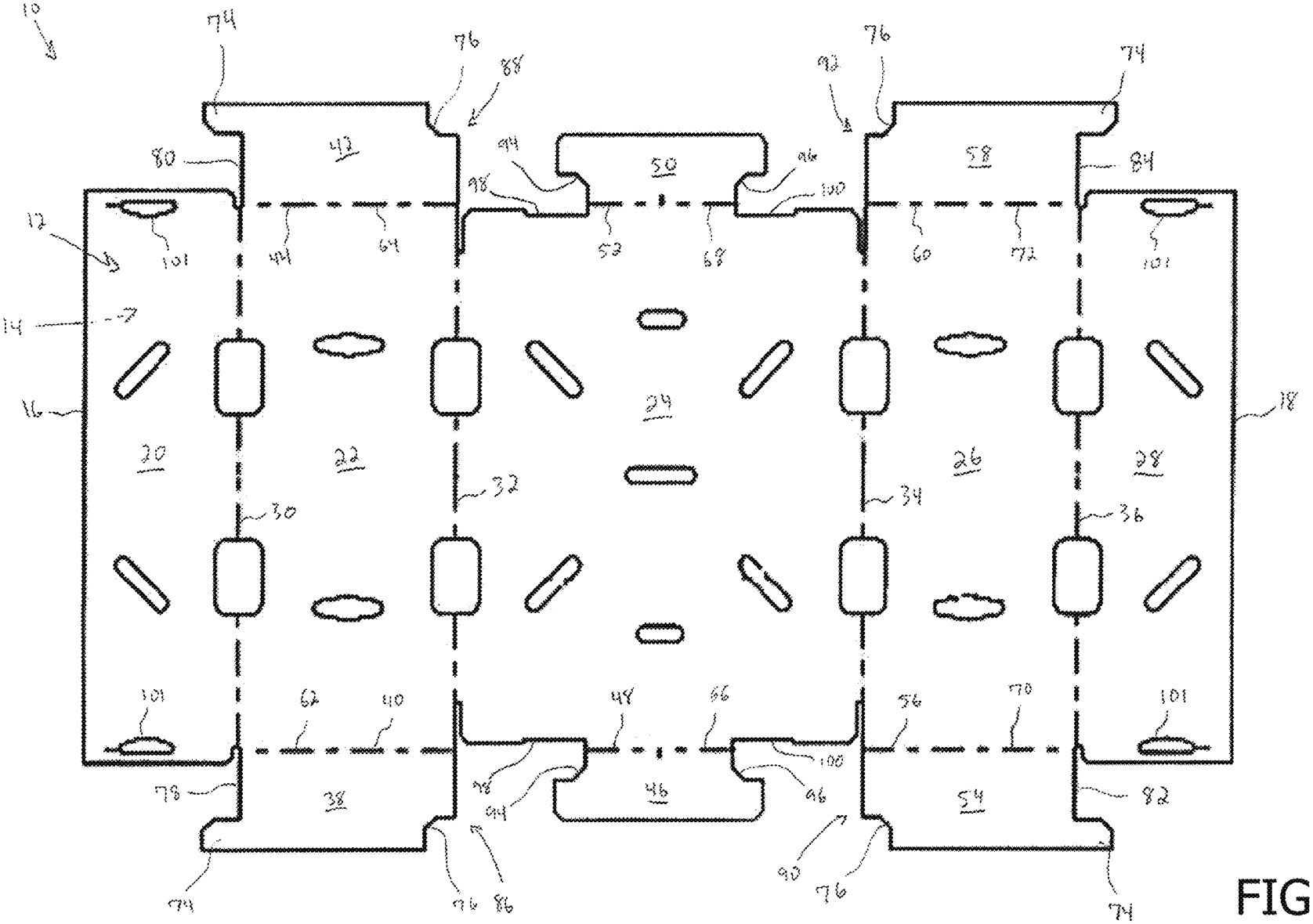
FIG. 1 is a top plan view of a body blank of sheet material for forming a body portion of a reinforced container in accordance with one embodiment of the disclosure.

The following detailed description illustrates the disclosure by way of example and not by way of limitation. The description enables one skilled in the art to make and use the disclosure, describes several embodiments, adaptations, variations, alternatives, and use of the disclosure, including what is presently believed to be the best mode of carrying out the disclosure.

Embodiments of a reinforced container and a blank assembly for constructing the reinforced container are described herein. More specifically, a reinforced container that includes a reinforcement structure, and methods for forming the container, are described herein. Although there are multiple embodiments, each embodiment includes a reinforcement structure formed on each end wall that projects inwardly into a cavity of the container. The resulting container provides substantially increased stacking strength while using a similar amount of sheet material as compared to other known containers. It will also be apparent to those skilled in the art and guided by the teachings herein provided that the disclosure is likewise applicable to any storage container including, without limitation, a carton, a tray, a box, or a bin.

In one embodiment, the reinforced container is fabricated from a sheet material, such as at least one of a corrugated board and paperboard material. The container, however, may be fabricated using any suitable material, and therefore is not limited to a specific type of material. In alternative embodiments, the container is fabricated using cardboard, plastic, and/or any suitable material known to those skilled in the art and guided by the teachings herein provided.

Embodiments of the present disclosure provide a container formed from multiple blanks of sheet material and having improved stacking strength when compared to conventional four-sided or eight-sided boxes. More specifically, the container includes a reinforcement structure, formed form a reinforcing end wall blank, that extends inwardly from the end wall towards an interior of the container. The reinforcement structure is formed from at least two reinforcement panels, which are defined along one of the end wall blanks by a plurality of fold lines. As such, the reinforcement structure provides additional compression strength to the container, which (i) reduces a likelihood of stacked containers nesting within each other, (ii) reduces a need for slip sheets between each container layer of a full pallet load, and (iii) reduces a need for different corrugated or paperboard inserts within the container. Moreover, the multi-piece design facilitates increasing the stacking strength of the container when compared to a one-piece design having similar features.

In one embodiment, the reinforced container and/or any of the blanks includes at least one marking thereon including, without limitation, indicia that communicates the product, a manufacturer of the product, and/or a seller of the product. For example, the marking may include printed text that indicates a product's name and briefly describes the product, logos and/or trademarks that indicate a manufacturer and/or seller of the product, and/or designs and/or ornamentation that attract attention. In another embodiment, the container is void of markings, such as, without limitation, indicia that communicates the product, a manufacturer of the product, and/or a seller of the product. Furthermore, the container may have any suitable size, shape, and/or configuration (i.e., number of sides), whether such sizes, shapes, and/or configurations are described and/or illustrated herein. For example, in one embodiment, the container includes a shape that provides functionality, such as a shape that facilitates transporting the container and/or a shape that facilitates stacking and/or arranging a plurality of containers.

Referring now to the drawings, FIG. 1 is a top plan (external) view of a body blank 10 of sheet material for forming a body portion of a reinforced container, such as container 200 (shown in FIG. 3) and/or container 300 (shown in FIG. 5), in accordance with one embodiment of the disclosure. In the example embodiment, body blank 10 has a first or exterior surface 12, and an opposing second or interior surface 14. Further, body blank 10 defines a leading edge 16 and an opposing trailing edge 18. Moreover, body blank 10 includes, from leading edge 16 to trailing edge 18, a first top panel 20, a first side panel 22, a bottom panel 24, a second side panel 26, and a second top panel 28 coupled together along preformed, generally parallel fold lines 30, 32, 34, and 36.

First side panel 22 extends from first top panel 20 along fold line 30, bottom panel 24 extends from first side panel 22 along fold line 32, second side panel 26 extends from bottom panel 24 along fold line 34, and second top panel 28 extends from second side panel 26 along fold line 36. Fold lines 30, 32, 34, and 36, as well as other fold lines and/or hinge lines described herein, may include any suitable line of weakness and/or line of separation known to those skilled in the art and guided by the teaching herein provided.

Body blank 10 also includes a plurality of flaps and/or panels for forming the container. For example, first side panel 22 includes a first side flap 38 extending therefrom along a fold line 40, and an opposing second side flap 42 extending therefrom along a fold line 44. Bottom panel 24 includes a first bottom flap 46 extending therefrom along a fold line 48, and an opposing second bottom flap 50 extending therefrom along a fold line 52. Second side panel 26 includes a third side flap 54 extending therefrom along a fold line 56, and an opposing fourth side flap 58 extending therefrom along a fold line 60. More specifically, first side flap 38 extends from a first side edge 62 of first side panel 22, second side flap 42 extends from a second side edge 64 of first side panel 22, first bottom flap 46 extends from a first end edge 66 of bottom panel 34, second bottom flap 50 extends from a second end edge 68 of bottom panel 24, third side flap 54 extends from a first side edge 70 of second side panel 26, and fourth side flap 58 extends from a second side edge 72 of second side panel 26.

In the example embodiment, side flaps 38, 42, 54, and 58 each include a partial locking tab 74 and a side flap cutout 76. More specifically, first side flap 38 includes partial locking tab 74 extending from a top edge 78 thereof, second side flap 42 includes partial locking tab 74 extending from a top edge 80 thereof, third side flap 54 includes partial locking tab 74 extending from a top edge 82 thereof, and fourth side flap 58 includes partial locking tab 74 extending from a top edge 84 thereof. Moreover, first side flap 38 includes side flap cutout 76 defined in a bottom portion 86 thereof, second side flap 42 includes side flap cutout 76 defined in a bottom portion 88 thereof, third side flap 54 includes side flap cutout 76 defined in a bottom portion 90 thereof, and fourth side flap 58 includes side flap cutout 76 defined in a bottom portion 92 thereof In addition, first bottom flap 46 includes a first bottom flap cutout 94 and a second bottom flap cutout 96, and second bottom flap 50 likewise includes first bottom flap cutout 94 and second bottom flap cutout 96. Moreover, bottom panel 24 includes a first notch 98 and a second notch 100 defined in first end edge 66 on opposing sides of first bottom flap 46, and bottom panel 24 includes first notch 98 and second notch 100 defined in second end edge 68 on opposing sides of second bottom flap 50. As such, as will be described in more detail below, respective side flap cutouts 76, first and second bottom flap cutouts 94 and 96, and first and second notches 98 and 100 at least partially define respective bottom slots 222 (shown in FIG. 3) of the container for receiving locking tabs of an adjacent container when multiple containers are stacked on top of each other.

Top panels 20 and 28 also include locking tab receiving slots 101 defined therein. As will be described in more detail below, locking tab receiving slots 101 are sized for engagement with locking tabs extending from a top edge of end walls of the container. As such, when engaged with the locking tabs, top panels 20 and 28 are selectively positionable between an open and closed position to enclose an interior cavity 210 of the container (shown in FIG. 3).

Figure 2:
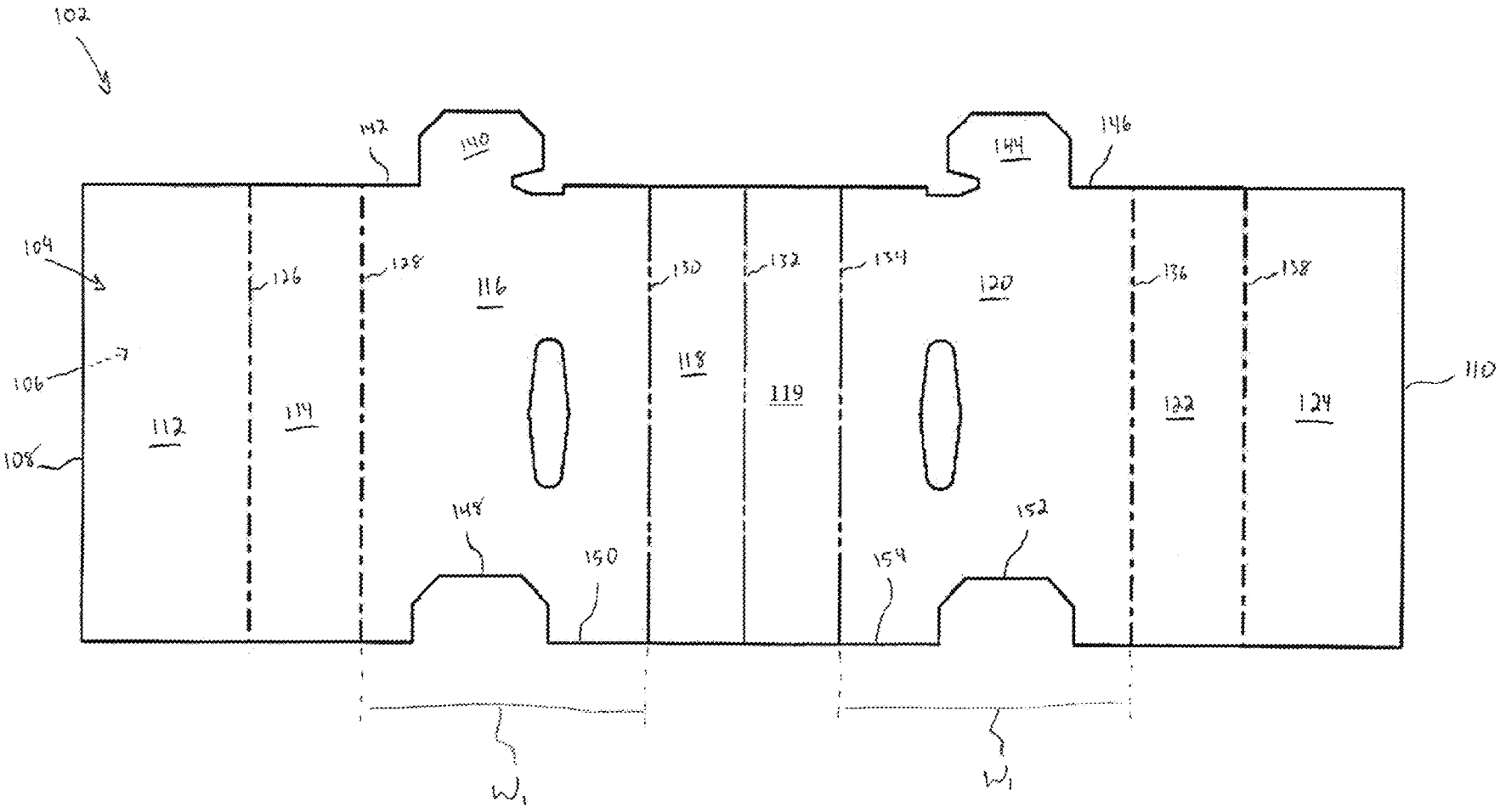
FIG. 2 is a top plan view of a reinforcing end blank of sheet material for forming an end wall insert portion of the reinforced container.

FIG. 2 is a top plan (external) view of an end blank 102 of sheet material. Body blank 10 and two end blanks 102 define a blank assembly for forming container 200 (shown in FIG. 3). In the example embodiment, end blank 102 has a first or exterior surface 104, and an opposing second or interior surface 106. Further, end blank 102 defines a leading edge 108 and an opposing trailing edge 110. Moreover, end blank 102 includes, from leading edge 108 to trailing edge 110, a first inner side panel 112, a first inner corner panel 114, a first inner end panel 116, a first reinforcement panel 118, a second reinforcement panel 119, a second inner end panel 120, a second inner corner panel 122, and a second inner side panel 124 coupled together along preformed, generally parallel fold lines 126, 128, 130, 132, 134, 136, and 138. First and second inner end panels 116 and 120 each have a first width $W_1$.

First inner corner panel 114 extends from first inner side panel 112 along fold line 126, first inner end panel 116 extends from first inner corner panel 114 along fold line 128, first reinforcement panel 118 extends from first inner end panel 116 along fold line 130, second reinforcement panel 119 extends from first reinforcement panel 118 along fold line 132, second inner end panel 120 extends from second reinforcement panel 119 along fold line 134, second inner corner panel 122 extends from second inner end panel 120 along fold line 136, and second inner side panel 124 extends from second inner corner panel 122 along fold line 138. In alternative embodiments, end blank 102 does not include first and second inner corner panels 114 and 122, and first and second inner side panels 112 and 124 extend directly from first and second inner end panels 116 and 120, respectively.

End blank 102 also includes a plurality of locking tabs that facilitate closing a top wall of the container. For example, a first locking tab 140 extends from a top edge 142 of first inner end panel 116, and a second locking tab 144 extends from a top edge 146 of second inner end panel 120. In addition, a first end blank cutout 148 is defined along a bottom edge 150 of first inner end panel 116, and a second end blank cutout 152 is defined along a bottom edge 154 of second inner end panel 120. As will be described in more detail below, first and second end blank cutouts 148 and 152 at least partially define respective bottom slots 222 (shown in FIG. 3) of the container for receiving locking tabs 140 and 144 of an adjacent container when multiple containers are stacked on top of each other.

Figure 3:
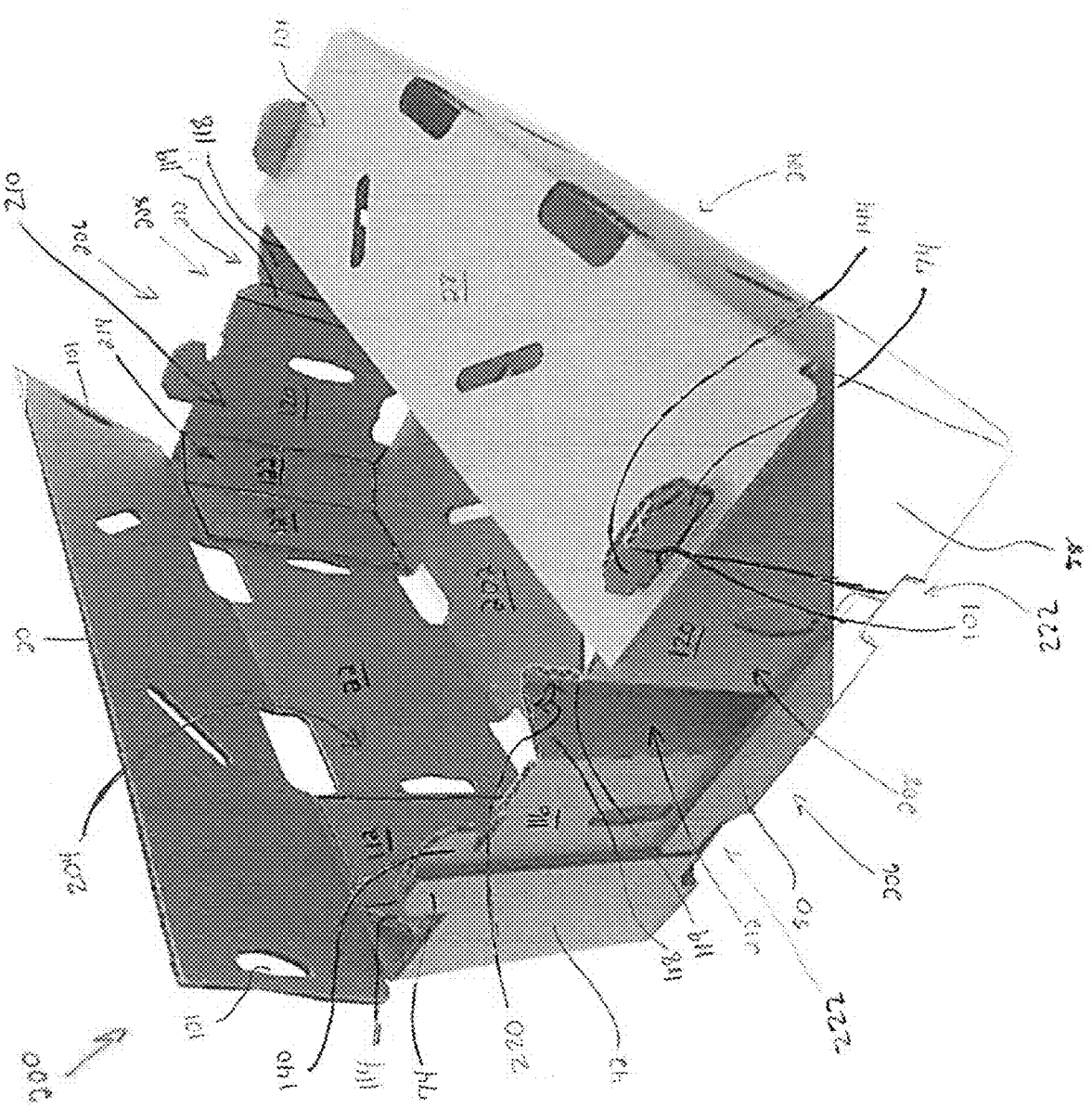
FIG. 3 is a perspective view of the reinforced container formed from the blanks shown in FIGS. 1 and 2.

FIG. 3 is a perspective view of container 200 formed from body blank 10 and two end blanks 102 (shown in FIGS. 1 and 2). In the example embodiment, container 200 includes a bottom wall 202 formed from bottom panel 24 of body blank 10, and two opposing side walls 204 at least partially formed from first side panel 22 and second side panel 26, respectively, of body blank 10. More specifically, in the example embodiment, each side wall 204 also includes first inner side panel 112 of one of end blanks 102, and second inner side panel 124 of the other of end blanks 102.

Container 200 also includes two opposing end walls 206. In the example embodiment, each end wall 206 is substantially perpendicular to each side wall 204. In alternative embodiments, at least one end wall 206 is other than substantially perpendicular to at least one side wall 204. A first of end walls 206 is formed from first side flap 38, third side flap 54, and first bottom flap 46 of body blank 10, and first inner end panel 116, first and second reinforcement panels 118 and 119, and second inner end panel 120 of one of end blanks 104. A second of end walls 206 is formed from second side flap 42, fourth side flap 58, and second bottom flap 50 of body blank 10, and first inner end panel 116, first and second reinforcement panels 118 and 119, and second inner end panel 120 of the other of end blanks 104. First inner end panel 116, first and second reinforcement panels 118 and 119, and second inner end panel 120 of each of end blanks 104 define a respective end wall insert portion 208 of container 200.

In the example embodiment, a height of each end insert portion 208 is substantially equal to a height of each side wall 204. More specifically, a height of first inner end panel 116, first and second reinforcement panels 118 and 119, and second inner end panel 120 is substantially equal to a height of first and second side panels 22 and 26 when container 200 is formed. In alternative embodiments, the height of at least one end insert portion 208 is other than substantially equal to the height of at least one side wall 204.

Also in the example embodiment, each of first inner corner panel 114 and second inner corner panel 122 of the two end blanks 104 forms a respective inner miter wall 214 at a respective corner of container 200. Each inner miter wall 214 extends obliquely between one of side walls 204 and one of end walls 206, adjacent a substantially right-angle outer corner formed by the side wall 204 and end wall 206. In alternative embodiments, container 200 does not include inner miter walls 214.

In the example embodiment, bottom wall 202, side walls 204, end walls 206, and inner miter walls 214 cooperate to define interior cavity 210 within container 200. Moreover, as will be described in more detail below, end wall insert portions 208 are foldable along fold lines 130, 132, and 134 (shown in FIG. 2) such that first and second reinforcement panels 118 and 119 extend inwardly from first and second inner end panels 116 and 120, respectively, towards interior cavity 210 of container 200 to form a reinforcement structure 212.

Container 200 is formed by folding body blank 10 and end blanks 102 along their respective preformed fold lines and coupling body blank 10 and end blanks 102. In the example embodiment, end wall insert portions 208 are formed by folding each end blank 102 about fold lines 130, 132, and 134 such that first and second reinforcement panels 118 and 119 rotate out of plane with respect to the adjacent first and second inner end panels 116 and 120, forming reinforcement structure 212. Thus, when coupled as part of container 200, first and second reinforcement panels 118 and 119 extend inwardly towards interior cavity 210 of container 200 to form reinforcement structure 212. In one embodiment, each end blank 102 is folded along fold lines 130, 132, and 134 such that first and second reinforcement panels 118 and 119 are oriented at an oblique angle 220 relative to each other. For example, angle 220 defined between first and second reinforcement panels 118 and 119 is within a range of between about 0 degrees to less than 180 degrees.

In the example embodiment, each end blank 102 also is rotated about fold lines 126 and 128, and about fold lines 136 and 138, such that first and second inner side panels 112 and 124 are substantially perpendicular to first and second inner end panels 116 and 120, first inner corner panel 114 is oriented obliquely between first inner side panel 112 and first inner end panel 116, and second inner corner panel 122 is oriented obliquely between second inner side panel 124 and second inner end panel 120.

In addition, side panels 22 and 26 of first blank 10 are rotated about fold lines 32 and 34 toward interior surface 14, such that side panels 22 and 26 are disposed substantially perpendicular to bottom panel 24. First side flap 38, third side flap 54, and first bottom flap 46 are rotated about respective fold lines 40, 56, and 48 toward interior surface 14, such that first side flap 38, third side flap 54, and first bottom flap 46 of body blank 10 are substantially perpendicular to side panels 22 and 26. Similarly, second side flap 42, fourth side flap 58, and second bottom flap 50 are rotated about respective fold lines 44, 60, and 52 toward interior surface 14, such that second side flap 42, fourth side flap 58, and second bottom flap 50 are substantially perpendicular to side panels 22 and 26.

Further in the example embodiment, interior surface 14 of first side panel 22 is coupled to exterior surface 104 of first inner side panel 112 of a first of end blanks 102, and to second inner side panel 124 of a second of end blanks 102. Similarly, interior surface 14 of second side panel 26 is coupled to exterior surface 104 of first inner side panel 112 of the second of end blanks 102, and to second inner side panel 124 of the first of end blanks 102. For example, but not by way of limitation, a suitable adhesive is applied to interior surface 14 of side panels 22 and 26 and/or exterior surface 104 of inner side panels 112 and 124.

Additionally or alternatively, interior surface 14 of first side flap 38, third side flap 54, and first bottom flap 46 is coupled to exterior surface 104 of first and second inner end panels 116 and 120 of the first of end blanks 102, and interior surface 14 of second side flap 42, fourth side flap 58, and second bottom flap 50 is coupled to exterior surface 104 of first and second inner end panels 116 and 120 of the second of end blanks 102. For example, but not by way of limitation, a suitable adhesive is applied to interior surface 14 of at least some of flaps 38, 54, 46, 42, 58, and 50 and/or exterior surface 104 of inner end panels 116 and 120.

Moreover, when side flaps 38, 42, 54, and 58 are coupled to respective inner end panels 116 and 120, partial locking tabs 74 at least partially align with locking tabs 140 and 144. As described above, locking tab receiving slots 101 are defined in top panels 20 and 28. Top panels 20 and 28 are selectively foldable along fold lines 30 and 36 for engaging locking tab receiving slots 101 with locking tabs 140 and 144 and respective aligned partial locking tabs 74, thereby selectively forming a top wall of container 200. Additionally, side flap cutouts 76, first and second bottom flap cutouts 94 and 96, first and second notches 98 and 100, and first and second end blank cutouts 148 and 152 cooperate to define bottom slots 222 adjacent bottom wall 202. Each bottom slot 222 is configured to receive one of locking tabs 140 and 144 and an aligned partial locking tab 74 of another container 200 stacked beneath.

Figure 4:
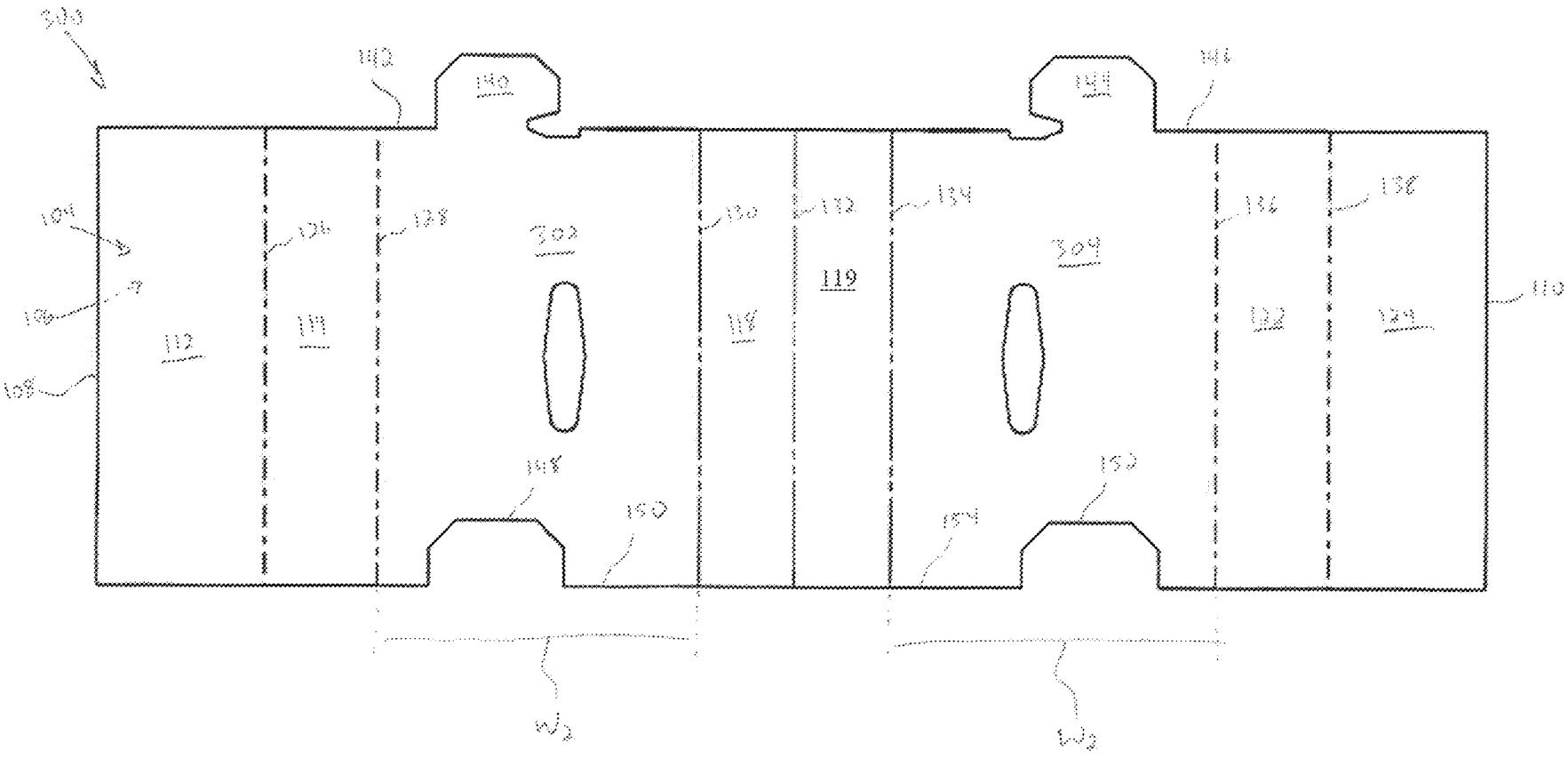
FIG. 4 is a top plan view of an alternative embodiment of the reinforcing end blank of sheet material for forming an end wall insert portion of the reinforced container in accordance with another embodiment of the disclosure.

FIG. 4 is a top plan view of an alternative embodiment of end blank 102, designated end blank 300, of sheet material. Body blank 10 and two end blanks 300 define a blank assembly for forming a container 308 (shown in FIG. 5) in accordance with another embodiment of the disclosure. End blank 300 is similar to end blank 102 in several respects, and like features are numbered alike. In the example embodiment, end blank 300 has first or exterior surface 104, and opposing second or interior surface 106. Further, end blank 300 defines leading edge 108 and opposing trailing edge 110. Moreover, end blank 300 includes, from leading edge 108 to trailing edge 110, first inner side panel 112, first inner corner panel 114, a first inner end panel 302, first reinforcement panel 118, second reinforcement panel 119, a second inner end panel 304, second inner corner panel 122, and second inner side panel 124 coupled together along preformed, generally parallel fold lines 126, 128, 130, 132, 134, 136, and 138. First and second inner end panels 302 and 304 have a second width $W_2$ greater than first width $W_1$ of minor end panels 116 and 120 of end blank 102.

Figure 5:
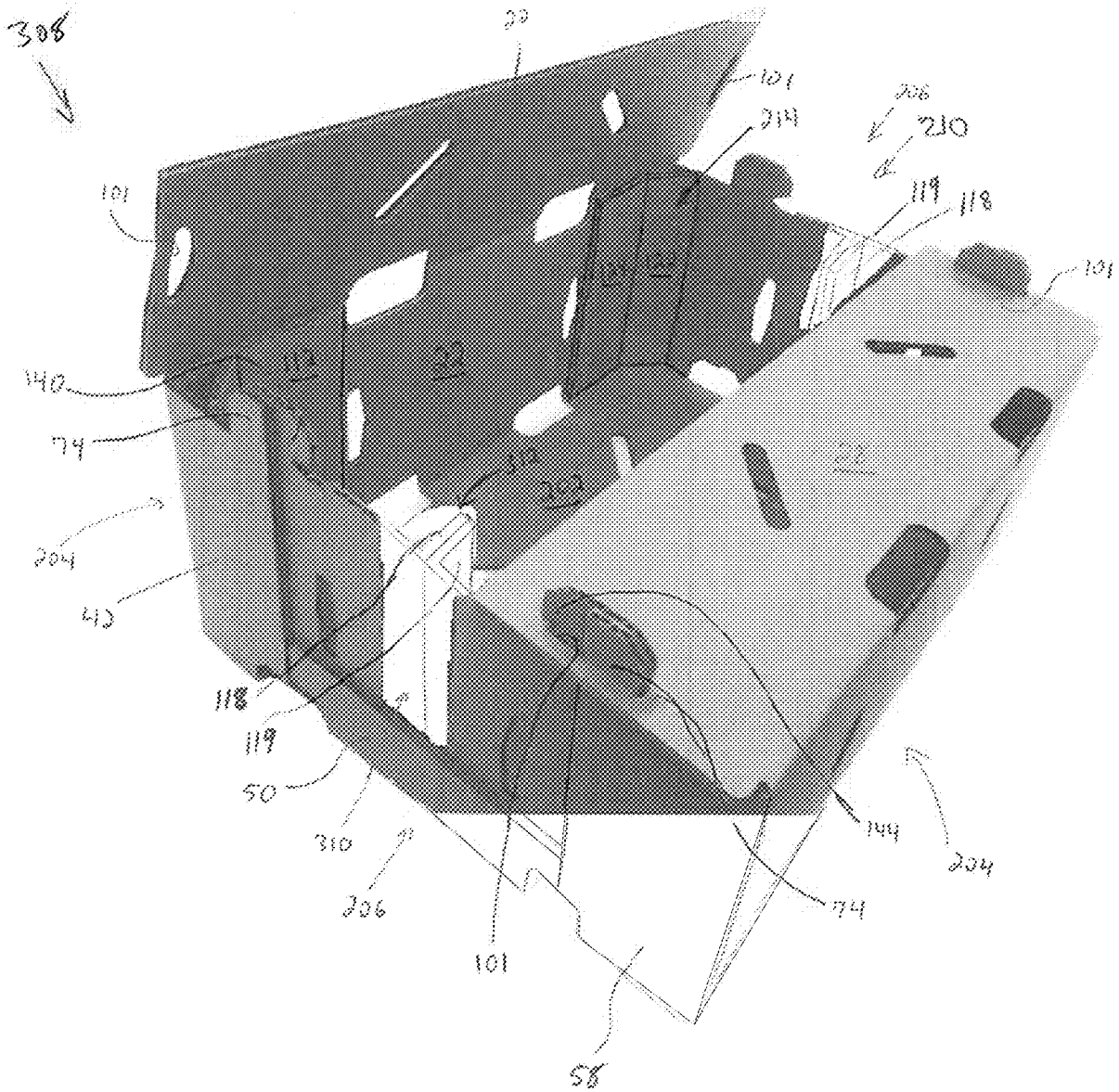
FIG. 5 is a perspective view of the reinforced container formed from the blanks shown in FIGS. 1 and 4.

FIG. 5 is a perspective view of container 308 formed from body blank 10 and two end blanks 300 (shown in FIGS. 1 and 4). Container 308 is similar to container 200 in several respects, and like features are numbered alike. In the example embodiment, container 308 includes bottom wall 202, two opposing side walls 204, two opposing end walls 206, and inner miter walls 214 that cooperate to define interior cavity 210 within container 308. Moreover, each end blank 300 is foldable along fold lines 130, 132, and 134 (shown in FIG. 4) such that first and second reinforcement panels 118 and 119 extend inwardly from first and second inner end panels 302 and 304, respectively, towards interior cavity 210 of container 308 to form a reinforcement structure 312. In one embodiment, each end blank 300 is folded along fold lines 130, 132, and 134 such that first and second reinforcement panels 118 and 119 are oriented in face-to-face contact with each other and, in one embodiment, glued together to form reinforcement structure 312.

In some embodiments, container 200 and/or container 300 is formed with a machine, such as a high-speed bliss container forming machine. The machine generally includes a horizontal track, a mandrel movable along the horizontal track, and a pair of hoppers along opposing sides of the horizontal track. Each of the pair of hoppers contains end blanks 200 or, alternatively, end blanks 300. With reference to FIGS. 1-5, container 200 or container 300 is formed by wrapping body blank 10 around the mandrel, and the mandrel includes multiple faces configured to orient side walls 22 and 26 and bottom wall 24 to at least partially form side walls 204 and bottom wall 206, as described above. Container 200 or container 300 is further formed by pre-folding each end blank 102 or 300 about fold lines 130, 132, and 134 to pre-form reinforcement structure 212 or 312, and, in some embodiments, further pre-folding each end blank 102 or 300 about fold lines 126, 128, 136, and 138, as described above. More specifically, pre-folding each end blank 102 or 300 includes forming reinforcement structure 212 or 312 before feeding end blank 102 or 300 to the hoppers.

In one embodiment, the hoppers include a recess sized to receive a corresponding reinforcement structure 212 or 312 therein to facilitate maintaining a shape of reinforcement structure 212 or 312 while forming container 200 or 300, respectively. Additionally or alternatively, a width of the hoppers is set to maintain each end blank 102 or 300 at its pre-folded width, and thus to inhibit each end blank 102 or 300 from expanding back to its larger, unfolded width. Adhesive is sprayed onto predetermined mating surfaces on either body blank 10 or end blank 102 or 300, and the machine couples body blank 10 to a pair of end blanks 102 or 300, as described above.

This written description uses examples to disclose various implementations, including the best mode, and also to enable any person skilled in the art to practice the various implementations, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A blank assembly for forming a container, the blank assembly comprising:

a body blank comprising a bottom panel and two opposing side panels, each of the two side panels extending from one of two opposing side edges of the bottom panel, the two side panels configured to at least partially form two opposing side walls of the container; and at least two end blanks, each end blank configured to form at least a portion of one of two opposing end walls of the container, each end blank comprising a first inner side panel, a first inner corner panel, a first inner end panel, a first reinforcement panel, a second reinforcement panel, and a second inner end panel coupled together in series, in the order recited, along a plurality of preformed, parallel fold lines, wherein the first inner side panel is configured to couple to one of the two opposing side panels, and the first inner corner panel is configured to extend obliquely between one of the side walls and one of the end walls, and the first reinforcement panel is configured to extend from the first inner end panel inwardly towards an interior cavity of the container, and the second reinforcement panel is configured to extend from the second inner end panel inwardly towards the interior cavity, and the first inner end panel and the second inner end panel together form said at least portion of said one of two opposing end walls when the container is formed.

2. The assembly in accordance with claim 1, wherein the first and second reinforcement panels are configured to be oriented at an oblique angle relative to each other when the container is formed.

3. The assembly in accordance with claim 1, wherein the first and second reinforcement panels are configured to be oriented in face-to-face contact with each other when the container is formed.

4. The assembly in accordance with claim 1, wherein each end blank further comprises a locking tab extending from a top edge of at least one of the first and second inner end panels.

5. The assembly in accordance with claim 4, wherein the body blank comprises a top panel extending from a top edge of at least one of the two opposing side panels, the top panel comprising a locking tab receiving slot defined therein and sized for engagement with the locking tab when the container is formed.

6. The assembly in accordance with claim 1, wherein a height of the first and second inner end panels and the first and second reinforcement panels is configured to be substantially equal to a height of the two side panels when the container is formed.

7. The assembly in accordance with claim 1, wherein the body blank comprises a bottom flap extending from an end edge of the bottom panel, the bottom flap configured to couple to the first and second inner end panels of one of the end blanks when the container is formed.

8. The assembly in accordance with claim 1, wherein the body blank comprises a side flap extending from a side edge of at least one of the two opposing side panels, the side flap configured to couple to one of the first and second inner end panels of one of the end blanks when the container is formed.

9. A container formed from a body blank and at least two end blanks of sheet material, the container comprising:

a bottom wall comprising a bottom panel of the body blank;

two opposing side walls emanating from opposing side edges of the bottom wall;

two opposing end walls each formed at least in part from a respective one of the two end blanks, each end blank comprising a first inner side panel, a first inner corner panel, a first inner end panel, a first reinforcement panel, a second reinforcement panel, and a second inner end panel coupled together in series, in the order recited, along a plurality of preformed, parallel fold lines; and wherein the first inner side panel is coupled to one of the two opposing side walls, and the first inner corner panel forms an inner miter wall that extends obliquely between one of the side walls and one of the end walls, and the first reinforcement extends from the first inner end panel inwardly towards an interior cavity of the container, and the second reinforcement panel extends from the second inner end panel inwardly towards the interior cavity, and the first inner end panel and the second inner end panel each form at least a portion of one of said opposing end walls.

10. The container in accordance with claim 9, wherein the first and second reinforcement panels are oriented at an oblique angle relative to each other.

11. The container in accordance with claim 9, wherein the first and second reinforcement panels are oriented in face-to-face contact with each other.

12. The container in accordance with claim 9, wherein each end wall comprises a locking tab extending at least partially from a top edge of at least one of the first and second inner end panels.

13. The container in accordance with claim 12, further comprising a top panel emanating from a top edge of at least one of the two opposing side walls, the top panel comprising a locking tab receiving slot defined therein and sized for engagement with the locking tab.

14. The container in accordance with claim 9, wherein a height of the first and second inner end panels and the first and second reinforcement panels is substantially equal to a height of the two side walls.

15. The container in accordance with claim 9, wherein the first end wall further comprises a bottom flap emanating from an end edge of the bottom wall, the bottom flap coupled to the first and second inner end panels of the first end wall.

16. The container in accordance with claim 9, wherein the first end wall comprises a side flap emanating from a side edge of one of the side walls, the side flap coupled to one of the first and second inner end panels of the first end wall.

17. A method of forming a container from a body blank and at least two end blanks of sheet material, each end blank comprising a first inner side panel, a first inner corner panel, a first inner end panel, a first reinforcement panel, a second reinforcement panel, and a second inner end panel coupled together in series, in the order recited, along a plurality of preformed, parallel fold lines, said method comprising:

rotating a bottom panel and two opposing side panels of the body blank about a plurality of fold lines of the body blank to at least partially form a bottom wall and two opposing side walls; and rotating the first inner corner panel and the first and second reinforcement panels of each end blank with respect to the first and second inner end panels of the respective end blank about plurality of preformed, parallel fold lines of the respective end blank; and coupling the first and second inner end panels of each end blank to the body blank to form two opposing end walls of the container, such that the first inner side panel is coupled to one of the two opposing side walls, such that the first inner corner panel extends obliquely between one of the side walls and one of the end walls, such that the first reinforcement panel extends from the first inner end panel inwardly towards an interior cavity of the container, such that the second reinforcement panel extends from the second inner end panel towards the interior cavity, and such that the first inner end panel and the second inner end panel each form at least a portion of one of the two opposing end walls.

18. The method in accordance with claim 17, wherein rotating the first inner corner panel and the first and second reinforcement panels comprises orienting the first and second reinforcement panels at an oblique angle relative to each other.

19. The method in accordance with claim 17, wherein rotating the first inner corner panel and the first and second reinforcement panels comprises orienting the first and second reinforcement panels in face-to-face contact with each other.

20. The method in accordance with claim 17, wherein each end blank includes a locking tab extending from a top edge of the first inner end panel, said method further comprising rotating a top panel emanating from a top edge of one of the two opposing side walls such that a locking tab receiving slot defined in the top panel engages the locking tab.

21. The method in accordance with claim 17, wherein coupling the first and second inner end panels of each end blank to the body blank further comprises coupling the first and second inner end panels of each end blank to the body blank such that a height of the first and second inner end panels and the first and second reinforcement panels is substantially equal to a height of the two side walls.

22. The method in accordance with claim 17, wherein coupling the first and second inner end panels of each end blank to the body blank further comprises coupling a bottom flap emanating from an end edge of the bottom panel to the first and second inner end panels of one of the end blanks.

23. The method in accordance with claim 17, wherein coupling the first and second inner end panels of each end blank to the body blank further comprises coupling a side flap emanating from a side edge of one of the two side panels to one of the first and second inner end panels of one of the second blanks.

* * * * *